United States Patent [19]

Strickland

[11] 4,323,736

[45] Apr. 6, 1982

[54] STEP-UP CIRCUIT FOR DRIVING FULL-RANGE-ELEMENT ELECTROSTATIC LOUDSPEAKERS

[76] Inventor: James C. Strickland, 3101 SW. First Ter., Fort Lauderdale, Fla. 33315

[21] Appl. No.: 176,668

[22] Filed: Aug. 11, 1980

[51] Int. Cl.[3] ..... H04R 3/06

[52] U.S. Cl. ..... 179/111 R

[58] Field of Search ..... 179/111 R, 111 E

[56] References Cited

FOREIGN PATENT DOCUMENTS

| | | | |
|---|---|---|---|
| 695243 | 12/1930 | France | 179/111 R |
| 345342 | 3/1931 | United Kingdom | 179/111 R |
| 1234767 | 6/1971 | United Kingdom | 179/111 R |

*Primary Examiner*—George G. Stellar

*Attorney, Agent, or Firm*—Ernest H. Schmidt

[57] ABSTRACT

An audio step-up circuit for driving an electrostatic loudspeaker of full-range-element configuration from a low voltage, low impedance, audio signal source utilizes two specially designed audio transformers in parallel-bilateral interconnection including R-C networks, one transformer being designed for optimum spectral response in the region of 30 Hz to about 5 kHz, and the other transformer being designed with cooperative added input impedance means for optimum spectral response in the region from a few hundred Hz to 20 kHz in such manner as to achieve an equalized-pass characteristic complementary to the loudspeaker therethrough in the audio range, while at the same time affording resonant conservation of energy at high frequencies.

9 Claims, 3 Drawing Figures

STEP-UP CIRCUIT FOR DRIVING FULL-RANGE-ELEMENT ELECTROSTATIC LOUDSPEAKERS

BACKGROUND OF THE INVENTION

The basic electrostatic mechanism of electromechanical transduction has been known and applied to various uses for over two hundred years. It was not until the period following World War II, however, that the availability of synthetic materials such as polyester film, polyvinyl-chloride insulation and other synthetic plastics having suitable properties made practical electrostatic loudspeakers possible. Recent embodiments of such electrostatic loudspeakers employ a polyester film diaphragm less than 17 microns in thickness with an extremely thin, applied electrically conductive coating, the diaphragm being suspended between two accoustically transparent plates, usually insulated with polyvinyl-chloride coating. These stator plates are ordinarily spaced so as to leave a diaphragm excursion gap of a few millimeters. A polarizing voltage of a few thousand volts D.C. is applied to the conductive coating on the diaphragm to spread charges uniformly over its surface. High voltage audio signals are applied to the outer opposed stator plates, usually in push-pull fashion for most linear operation. The advantages of such electrostatic transducers are uniquely desirable for the following reasons:

(1) If a diaphragm charge is kept constant, which is easy to do, the forces appearing on the diaphragm vary only with the audiovarying electric fields on the stators, and do not depend on diaphragm position in the intervening space between the stators.

(2) Since the charges on the diaphragm reacting to the electrostatic field are typically less than a wavelength of light apart, the induced forces will be substantially uniform over the entire diaphragm surface.

(3) The force per unit area (pressure) created on the diaphragm will be the same for any size of transducer, all other parameters being held equal.

These ideal properties are shared by no other known audio transducer, and can result in highly accurate sound reproduction spanning the entire audio spectrum from 20 Hz to 20 kHz utilizing one or more electrostatic elements, each of which operates throughout the entire range of audio frequencies.

A practical full-range-element electrostatic loudspeaker will typically require a total diaphragm surface area of 0.5 to 1.0 square meters for good acoustic impedance match if high efficiency and output are to be obtained. This area is usually subdivided into several bays to solve problems of diaphragm resonant frequency, stability and dispersion. At the same time, low mass per unit area of the diaphragm is required for accurate high frequency reproduction. Such practical electrostatic loudspeakers will typically present a stator-to-stator capacitance of about one nanofarad ($10^{-9}$ Farad) per square meter.

Despite their commanding natural advantages, electrostatic loudspeakers to the present time represent an almost negligible fraction of existing loudspeakers in use. The reasons for such general lack of acceptance of electrostatic loudspeakers as a practicable competitor with electrodynamic loudspeaker systems, for example, resides mainly in the difficulties in designing a satisfactory audio power drive interface between existing audio power amplifiers having ordinary low signal voltage output characteristics and the electrostatic transducer. The first problem with such an electrostatic transducer driving interface resides in the difficulty in achieving accurate high-voltage audio drive signals. The second difficulty in interface design resides in the capacitive nature of the electrostatic transducer's load characteristic, reflecting radical impedance changes over the approximately 1,000:1 range of the audio frequency band. The third difficulty resides in the requirement for significant spectral equalization for the electrostatic transducer's voltage-to-acoustic transfer characteristic spanning a ratio of more than ten decibels. All of these design criteria must be incorporated in the interface driving means if a practical full-range-element electrostatic loudspeaker system is to be achieved, and must be effective at modest cost to be competitive with electrodynamic loudspeaker systems, for example, which presently dominate the field.

Various attempts to design a power amplifier interface for full-range-element electrostatic loudspeakers and to be driven by ordinary low voltage output power amplifiers which are commonly available at modest cost, and at the same time satisfactorily meet the above described design criteria, have been unsuccessful. Principally, such attempts have involved the use of a single audio step-up transformer to raise the low voltage output signal of an ordinary power amplifier by a factor of about 100:1 for proper voltage drive of the electrostatic loudspeaker. Studies of transformer physics and scaling laws, however, demonstrate that it is impractical to make one transformer accomplish this magnitude of step-up, working into a one nanofarad load over the full range of the audio band. Such systems are characterized by inefficiency, poor spectral balance, and large, very costly transformers. FIG. 1 illustrates this classical approach in the prior art.

The use of two or more transformers to extend flat-amplitude band-pass in a general purpose transformer coupling system is also known, as described, for example, in U.S. Pat. No. 3,231,837 to O'Meara. The resulting, flat, all-pass characteristics detailed in such multiple transformer systems of the type described in the O'Meara patent, however, are not suited to the resolution of the above described matching and full range driving problems peculiar to electrostatic loudspeakers. In particular, no provision is made for correction for the serious impedance fluctuation character of the electrostatic transducer with frequency; no provision is made to fulfill the important need for spectral equalization in which drive voltages are required to vary over more than a ten decibel range in the audio spectrum; and no provision is made for achieving acceptable drive efficiency at high frequencies.

Because of the above described unresolved problems heretofore experienced in the design of interface circuitry driven by existing low voltage audio amplifiers, full-range-element electrostatic loudspeakers have been most successfully driven by specially designed and dedicated high-voltge amplifiers supplying audio signals of about two orders of magnitude higher amplitude than commonly available in existing amplifiers. Such dedicated high voltage amplifiers invariably incorporate equalized pass response networks. Because of their comparative high cost and specialized nature, they have enjoyed only minimal acceptance by the general public for use in high fidelity audio systems utilizing electrostatic speakers.

BRIEF SUMMARY OF THE INVENTION

It is, accordingly, the principal of this invention to provide a novel and improved driving means for full-range-element electrostatic loudspeakers which obviates the deficiencies of both dedicated high voltage driving means, and low audio voltage driven high voltage interface systems heretofore devised for driving electrostatic loudspeakers.

A more particular object of this invention is to provide a step-up circuit for driving a full-range-element electrostatic loudspeaker from a low voltage, low impedance, audio signal source, utilizing two specially designed audio transformers in parallel-bilateral interconnection including R-C networks, one transformer being designed for optimum spectral response in the region of 30 Hz to about 5 kHz, and the other transformer being designed with cooperative added input impedance means for optimum spectral response in the region from a few hundred Hz to 20 kHz, the interconnecting circuitry being cooperative therewith to achieve an equalized-pass characteristic complementary to the loudspeaker therethrough in the audio range, while at the same time affording a novel method of resonant conservation of energy at high frequencies.

Another object is to provide an electrostatic loudspeaker step-up circuit of the character described which will effect appropriate impedance match to both the speaker and an amplifier of conventional low voltage design; which will effect the necessary response equalization required for a full-range-element electrostatic speaker to be musically "flat;" which minimizes certain distortion problems associated with inherent transformer properties; and which obviates for the most part impedance match design difficulties associated with the almost totally capacitive nature of electrostatic transducers.

Yet another object of the invention is to provide an electrostatic loudspeaker driving interface of the character above described which will be comparatively compact and light in weight, and much more economical in comparison with the driving systems heretofore devised.

Other objects, features and advantages of the invention will be apparent from the following description when read with reference to the accompanying drawings.

Figure 1:
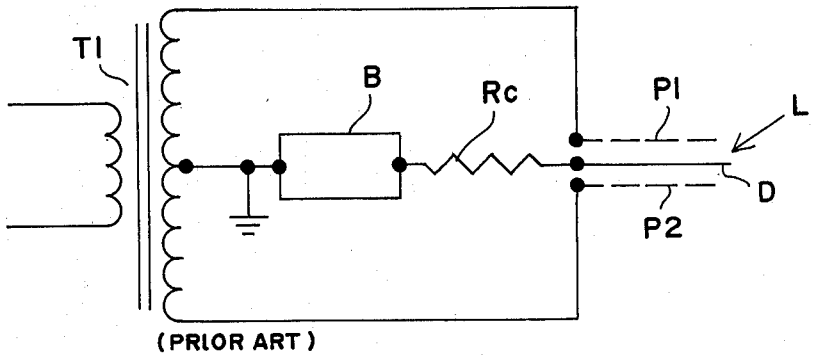
FIG. 1 is a schematic diagram utilizing a single transformer drive circuit for full-range-element electrostatic loudspeakers, illustrative of the prior art.
Figure 3:
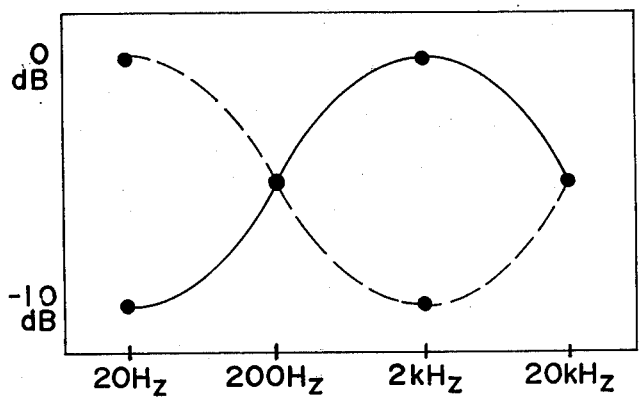
FIG. 3 is a graphical representation of the voltage-to-acoustic output characteristic of an ordinary unequalized full-range-element electrostatic loudspeaker (full-line curve) and the reciprocal pass response of the driving circuit embodying the invention (broken-line curve) whereby spectral equalization is achieved.

Referring first to the prior art of FIG. 1, utilizing a single transformer drive in push-pull, constant charge configuration a transformer T1 having a step-up ratio of approximately 100 to 1 has its secondary winding high potential terminal leads connected one each to the stator plates P1, P2 of electrostatic loudspeaker L. The center tap of the secondary is grounded for push-pull operation. A DC bias supply B supplying 5 to 15 kilovolts has its high voltage output potential connected through a high resistance "constant charge" resistor Rc to the conductive diaphragm D of the loudspeaker L. The resistor Rc is of very large value, in the order 100 or more megohms to practically eliminate short-time charge variation. The low potential side of the DC bias supply B is also returned to ground for effective push-pull operation. This simple transformer coupling circuit has several serious deficiencies which make it basically unfeasible. If the transformer T1 has sufficient primary turns and core material not to saturate magnetically at reasonable inputs of about 20 volts at 30 Hz, then the secondary, wound with 100 times as many turns, will have such a high inductive impedance that it will not be even remotely capable of driving a typical electrostatic speaker capacitance of about one nanofarad at high audio frequencies. Moreover its resonant responses will lie well in the middle of the audio band, making wide-range throughput response virtually impossible. This deficiency problem can be ameliorated to some extent at unacceptable economic cost by making the transformer very large physically, since the scaling laws for transformers show that every time all linear dimensions of a transformer design are doubled, it is possible to wind for half the primary and secondary inductances, at the original primary-to-secondary ratio and primary saturation voltage. Thus a significant reduction of secondary inductance comes unacceptably slowly with drastic increases in size, weight and cost.

Figure 2:
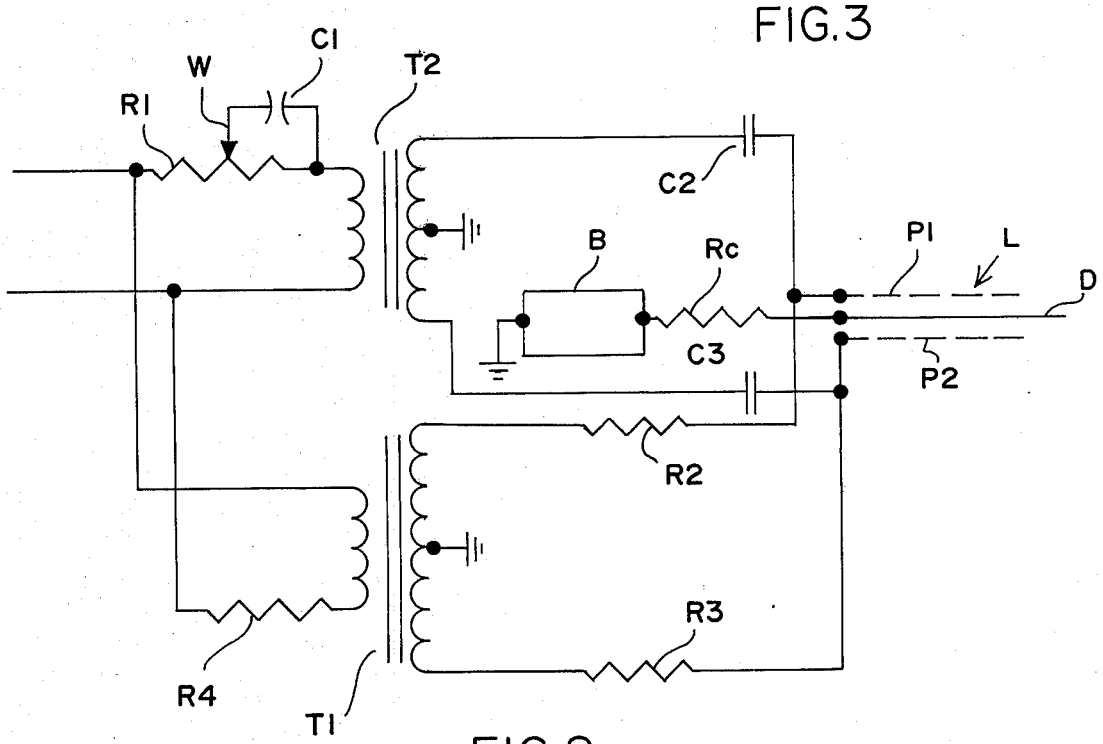
FIG. 2 is a schematic diagram illustrating the parallel bi-lateral interconnecting circuitry utilizing two transformers in an electrostatic loudspeaker amplifier system embodying the invention.

Referring now to FIG. 2, which schematically illustrates a preferred form of the invention, the above described deficiencies, inefficiencies and comparatively high cost of prior step-up transformer interface systems are obviated by the use of two specially designed transformers T1, T2 in parallel-bilateral interconnection, cooperatively connected with circuit components as hereinafter described to achieve the advantages of optimum performance with transformers of modest size and cost that coupling transformers alone, that is, transformers without the characteristics and inter-coupling circuitry as is hereinbelow more particularly described, cannot provide.

Transformer T1 is designed for optimized response in the region of 30 Hz to about 5 kHz. It typically has about 40–60 turns on the primary of a 3 sq. inch tongue iron-core, conventional "E" and "I" transformer. Its primary will reach 15,000 Gauss at about 15–25 volts input at 30 Hz. It has a step-up ratio of about 200:1, with its secondary winding center-tapped; and does not couple significant power above 5 kHz because its primary and secondary inductive impedances limit the load currents that can be delivered above this frequency.

Transformer T2 is optimized to operate from a few hundred Hertz to about 20 kHz. Its primary turns and core size are carefully selected with considerations involving step-up ratio and secondary resonant properties with the capacitive load of about 1 nanofarad presented by the electrostatic loudspeaker L. This "E-I" transformer as so designed has about one-half the tongue-core area of transformer T1, and has less than half the primary turns thereof. Its primary saturation frequency is typically about five times higher than that of transformer T1, for the same 15–25 volts signal input.

The "roll-in", with increasing frequency, of drive to the primary of transformer T2 is controlled by the network comprising series-parallel connected potentiometer R1 and AC capacitor C1 in series with the primary winding of transformer T2. The first "roll-in" point is determined by the total resistance of potentiometer R1 looking into the relatively low inductance of the primary winding of transformer T2. Further "roll-in" is provided by capacitor C1, at higher frequencies. Transformer T2 has about a 60:1 step-up ratio and is also center-tapped.

The primary windings of the step-up transformers T1, T2 are each connected to the low voltage audio input, the primary winding of transformer T1 being connected through R4 and the transformer T2 having series-connected therewith an adjustable, series-parallel-connected R-C network comprising capacitor C1 and potentiometer R1, as is above described. The secondary winding leads of transformer T1 are connected through respective equal series resistors R2, R3 to the stator plates P1, P2 of the electrostatic loudspeaker L. The secondary winding leads of transformer T2 are similarly connected through series capacitors C2, C3 to respective electrostatic loudspeaker stator plates P1, P2 thereby establishing parallel-bilateral interconnection between the transformers at the input of the electrostatic loudspeaker. As illustrated in the prior art example of FIG. 1, a DC bias supply B supplying 5 to 15 kilovolts, has its high voltage output potential connected through a high resistance "constant charge" resistor Rc to the conductive diaphram D of the electrostatic loudspeaker L. As described above, the resistor Rc has value of 100 or more megohms to practically eliminate short-time charge variation. The low potential side of the DC bias supply is returned to a common ground with the secondary center-taps of the transformers T1 and T2 for effective push-pull operation.

Capacitors C2 and C3 form a high-pass network with resistors R2 and R3, respectively, and serve to couple the higher audio frequencies from transformer T2 into the full range electrostatic loudspeaker L. Resistors R2 and R3 form a low-pass network with respective capacitors C2 and C3, and serve to couple the lower audio frequencies from transformer T1 into the electrostatic loud-speaker L.

In operation, the two transformers T1 and T2 are utilized in such a manner that they are both always partially operative over the entire audio band. To this and, the secondary equalization network comprising resistors R2 and R3 and capacitors C2 and C3 cooperates to select the required magnitude of drive and impedance level from the two transformers to compensate for the loudspeaker response and impedance characteristics. The transformer T1 is designed to allow a comparatively large step-up of about 200:1 at the low frequencies where the electrostatic loudspeaker requires large voltage drive because of falling acoustical radiation resistance. Its primary winding has a resistive limit impedance R4 to limit saturation currents, thereby insuring that magneto effects will not generate destructive potentials due to rapidly collapsing fields. The resistive limit impedance of the primary winding of transformer T1 also serves to attenuate objectional subsonic signals in cooperation with the falling low-frequency inductance of T1, to such an extent that they will reach the electrostatic speaker at significantly reduced levels.

The transformer secondary side R-C networks can be viewed as low pass filters in the path from T1 to the loudspeaker with a shelving character on the falling high frequency skirts. The shelf response is determined by the lower turns ratio of transformer T2 and is typically about 10 to 12 decibels below the 30 Hz throughput of the system.

The ability of the circuitry to function in such a manner as to resolve the deficiencies of interface drive means for electrostatic loudspeakers heretofore known is determined primarily by the nature and manner of operation of the transformer T2, this operation being far more complex than the simple 60:1 step-up function of its windings might suggest. As hereinafter more particularly described, transformer T2 functions as a variable-ratio transformer, with its step-up ratio rising well above its wound ratio with frequency above 2 kHz, this behavior being forced to occur by virtue of the unique network conditions in its primary and secondary circuits and the interaction between them.

The primary winding of transformer T2 is fed signal currents through the total resistance of potentiometer R1 at all frequencies. This R-L network including the primary winding of transformer T2, because of the falling inductive reactance thereof with frequency, results in an input voltage-versus-frequency drive into the transformer maintaining its primary voltage below magnetic saturation at all audio frequencies.

The reactive load presented by the inherent loudspeaker capacitance reflected through secondary winding coupling capacitors C3, C3 causes the primary winding of transformer T2 to draw additional current at higher frequencies. The additional current passthrough of input-winding capacitor C1 is an essential feature of overall circuit operation. The series-parallel connection of capacitor C1 with potentiometer R1 through the potentiometer wiper tap, controls the effective source impedance of drive to the primary winding of T2, which, as will be apparent, is of much greater significance than its effect in controlling the drive magnitude into the primary winding. It is important to note at this point that if only a capacitive coupling element existed in series with the input circuit to the primary of transformer T2, a high Q series resonance would occur in these two elements, yielding a highly peaked response, large primary currents, transformer saturation, and overloading of the driving amplifier. Use of the series-parallel R-C network comprising capacitor C1 and potentiometer R1 as herein described, however, damps such resonance to produce an extremely smooth "roll-in" of drive voltage to transformer T2, without overshoot or peaking. Transformer T2 and its associated circuitry provides the necessary rising drive levels above 2 kHz. to compensate for electrostatic loudspeaker roll-off due to diaphragm mass and size-to-wavelength ratio. This is accomplished, moreover, while at the same time materially increasing the high frequency power efficiency of the system, as is next described.

Transformer T2 has two basic resonant modes possible in its interaction with the two series capacitors C2, C3 and the inherent electrostatic speaker capacitance. The obvious mode is the frequency determined by the value of this net series capacitance and the measured iron-core inductance of the secondary winding of transformer T2. If this phenomenon were allowed to be dominant, the transformer would step up at 60:1 at all frequencies, and show a tracking peak in primary and secondary impedance at about 2 kHz, with severe response attenuation above and below this resonant frequency. This behavior can be demonstrated anytime T2 is driven from a reasonably high impedance source.

When, as in the invention, T2 is driven from a controllable low source impedance, a few to near zero, ohms, a radically different and needed behavior is elicited. This behavior can be explained as follows. As energy is transferred from primary to secondary in T2, it becomes temporarily stored as potential electrical energy in the total capacitive load in the secondary circiut. Classical resonance theory predicts that this potential energy will shortly begin to discharge as a current into the secondary of T2. As the source impedance driving the primary winding of T2 is reduced toward zero, this controlled impedance path refuses to allow the secondary resonant currents to induce full reciprocal voltage back into the primary. When this occurs, the high inductance contribution of the iron core effectively disappears, resulting in a secondary inductance which is about 100 times lower, i.e. a value near the no-iron or "air-core" value. This value now determines the secondary resonance in cooperation with the net value of capacitive load on this secondary. Since this "air-core" inductance value is about one percent of the iron-core value, the resonant frequency is shifted up by roughly a factor of ten, to the very top of the audio band. This action temporarily traps high frequency energy in this "air-core" resonance because of the forced irreversibility of energy flow back through the shunted iron core path.

The stored energy in this high frequency resonance now adds to energy flow arriving per-cycle from the primary circuit by induction, yielding a rising step-up ratio toward the top of the audio band. The degree of this rise can allow the 60:1 transformer T2 to actually manifest an effective maximum voltage step-up ratio of over 200:1. Although the primary impedance of transformer T2 does go down somewhat under these conditions, this impedance remains many times higher than it would have been had the resonant energy storage method been replaced by an equivalent pure transformer step-up. This "magne-kinetic" energy augmentation is highly important in the specific case of driving the highly capacitive, very low power-factor load of a large electrostatic loudspeaker array at high frequencies, because prior drive methods turn virtually all drive energy into heat in the resistances of the driving amplifier's output devices, resulting in very low transfer efficiency, and hence a very large, expensive amplifier requirement. The above described resonant augmentation has a parallel in the use of mechanical resonant assistance for extension of loudspeaker bandpass and efficiency at low frequencies, a common technique in almost all loudspeaker design.

In summary, the basic reasons for the use of the two transformer configuration are:

1. To allow the advantages of the forced "air-core" resonance storage, at a proper frequency.
2. To allow significant differences in step-up ratios, at different frequencies, for equalization purposes.
3. To allow radical reduction of secondary inductive impedance with rising frequency to match the drastically falling impedance of the speaker at high frequencies.

In practice, the iron-core secondary inductance of transformer T2 should be about 1.5% of the iron-core secondary inductance of transformer T1. The design of transformer T2 will also be such that its "air-core" secondary inductance is about 100 times less than its iron-core value for optimum performance.

The aforesaid variable-ratio action of T2 is controlled by the position of the wiper W on R1. As this wiper is moved toward the input drive from a low-source-impedance amplifier (a typical high fidelity unit), two mechanisms occur. First, more high frequency excitation is passed through C1 into the primary of T2. Second, and far more important, the source impedance into which the primary of transformer T2 looks back becomes closer to zero ohms. The magnitude of the aforesaid "air-core" augmentation of high frequency drive is directly related to the degree to which the transformer T2 primary looks back into a low generator impedance. This control, R1, is an essential element allowing the magnitude of increesed high frequency drive to be achieved and adjusted to compensate the loudspeaker characteristic for proper spectral balance.

Further advantages are gained from the equalization network C2, C3 and R2, R3. At frequencies where the reactance of the speaker capacitance is high, the dominant load nature on the secondary of transformer T1 is determined by resistors R2 and R3. This causes the primary vector impedance of transformer T1 to be more resistive, a condition highly favorable as a load for the driving amplifier.

The above-described equalization network also reduces certain inherent transformer distortions, as will now be explained. Resistors R2 and R3 act as low-pass filters looking into capacitors C2 and C3, and the speaker capacitance. This action tends to reduce the higher order, dominantly odd, harmonic distortion products intrinsic to transformer hysteresis and saturation. Further, C2 and C3 form a high-pass filter from T2 into R2 and R3. This action tends to delay dominant feed of the speaker from T2 until the frequencies are sufficiently high that its magnetic non-linearity distortions are at low levels, i.e. frequencies where magnetization levels are considerably below saturation of the core of transformer T2. Thus the equalization network results in an electrical throughput having lower distortion than either transformer alone would allow. It will be understood from the foregoing that each transformer is in effect "brought-on-line" at the boundaries of a overlapping frequency zone, whereupon a "resynthesis" of the full audio spectrum is achieved in the output by virtue of band-pass coupling network R2, R3 and C2, C3 to provide for smooth transition of dominant drive from the low frequency transformer T1 to the high frequency transformer T2. The herein described technique and circuitry has been found to yield extremely smooth amplitude, phase and impedance transitions while at the same time minimizing sonic degradation that a sharp cross-over would produce, and achieving high coupling efficiency. Test results have verified that overall system efficiency is about an order of magnitude higher than previous transformer interface methods driving a full-range-element electrostatic loudspeaker.

While I have illustrated and described here a preferred embodiment of my electrostatic loudspeaker audio drive means, this embodiment is presented by way of example only and not in a limiting sense. The invention, in brief comprises all the embodiments and modifications coming within the scope and spirit of the following claims.

What I claim as new and desire to secure by Letters Patent is:

1. An audio step-up circuit for driving full-range-element electrostatic loudspeakers of the type having a flat conductive diaphragm suspended in spaced, parallel relation between a pair of opposed, acoustically transparent stator plates comprising, in combination, a first audio signal voltage step-up transformer for signal voltage step-up at lower audio frequencies of the 30 Hz to 20 kHz audio frequency band, a second audio signal voltage step-up transformer of substantially lesser turns ratio as compared with said first transformer for signal voltage step-up at higher audio frequencies of said 30 Hz to 20 kHz audio frequency band, means for connecting the primary winding of said second transformer to a low voltage, low impedance audio signal source, said connecting means including an adjustable series-parallel RC network in series with said primary winding of said second audio transformer, the secondary windings of said transformers each being center-tapped with the center-taps returned electrically to a common low potential "ground" return for push-pull output operation, a capacitor connected in series with each of the secondary winding terminal leads of said second transformer for capacitive coupling to the stator plates of an electrostatic loudspeaker and a resistive element connected in series with each of the secondary winding terminal leads of said first transformer for resistance coupling to the stator plates of the electrostatic loudspeaker, whereby the output circuits of said first and second transformers will be in parallel-bilateral interconnection for cooperatively feeding the stator plates of the electrostatic loudspeaker, and means for supplying a substantially constant high voltage electrostatic charge to the conductive diaphragm of the electrostatic loudspeaker.

2. An audio step-up circuit as defined in claim 1 wherein the step-up winding ratio of said first transformer as compared with said second transformer is about 3:1, for augmenting low frequency drive voltage, and means including said step-up winding for optimizing pass-through response of said first transformer in the 30 Hz to 5 kHz audio frequency band and for optimizing pass-through response of said second transformer in the few hundred Hz to about 20 kHz audio frequency band.

3. An audio step-up circuit as defined in claim 2 wherein said pass-through optimizing response means of said second transformer effects a shunted-iron shift of secondary resonant frequency to approximately the "air-core" value near 20 kHz, producing a step-up ratio above wound value, thereby materially increasing high frequency drive efficiency.

4. An audio step-up circuit as defined in claim 2 wherein said pass-through optimizing response means further comprises the said transformers being of such design that the saturation frequency of said second transformer is approximately five times greater than the saturation frequency of said first transformer for the same voltage input, whereby said second transformer will only respond to full input voltage at frequencies of at least five times higher than the 30 Hz lower limit of said first transformer.

5. An audio step-up circuit as defined in claim 2 wherein said pass-through optimizing response means of said first transformer further comprises said primary and secondary windings of said first transformer having such inductive impedances as limit output currents which can be delivered to the secondary loads at frequencies above approximately 5 kHz, thus reducing high frequency primary currents.

6. An audio step-up circuit as defined in claim 5 wherein said first transformer comprises an approximately three square-inch central laminated magnetic core tongue having a sufficient primary to reach a magnetic induction of approximately 15,000 Gauss with an input of about 15–25 volts at 30 Hz.

7. An audio step-up circuit as defined in claim 6 wherein the tongue-core area of said second transformer is approximately one-half that of said first transformer, and the iron core inductance of the secondary of said second transformer is about 1.5% of that of said first transformer.

8. An audio step-up circuit as defined in claim 6 wherein said series capacitors and said series resistive elements in the respective secondary windings of said second and first transformers comprise low pass filter networks in the path from said first transformer to the electrostatic loudspeaker serving to attenuate odd-harmonic distortion created by the magnetic properties of said first transformer.

9. An audio step-up circuit as defined in claim 8 wherein said series capacitors and said series resistors comprise high pass filter networks between said second transformer and the electrostatic loudspeaker, whereby dominant throughput in this path will be at frequencies well beyond second transformer core saturation.

* * * * *